US009370723B2

(12) United States Patent
Lau

(10) Patent No.: US 9,370,723 B2
(45) Date of Patent: Jun. 21, 2016

(54) SQUEEZABLE FACE-COVERING TOY AND ITS SQUEEZE MECHANISM

(71) Applicant: WOW! Creations HK Limited, Hong Kong (HK)

(72) Inventor: Chun Yuen Lau, Hong Kong (HK)

(73) Assignee: WOW! CREATIONS HK LIMITED, Hong Kong (HK)

( * ) Notice: Subject to any disclaimer, the term of this patent is extended or adjusted under 35 U.S.C. 154(b) by 0 days.

(21) Appl. No.: 14/876,853

(22) Filed: Oct. 7, 2015

(65) Prior Publication Data

US 2016/0101365 A1 Apr. 14, 2016

(30) Foreign Application Priority Data

Oct. 8, 2014 (CN) ..... 2014 2 0582346 U

(51) Int. Cl.
*A63H 3/20* (2006.01)
*A63H 3/28* (2006.01)
*A63H 13/02* (2006.01)

(52) U.S. Cl.
CPC .. *A63H 3/20* (2013.01); *A63H 3/28* (2013.01); *A63H 13/02* (2013.01)

(58) Field of Classification Search
USPC ..... 446/298, 330, 331, 365, 366, 340, 359, 446/369, 370, 375
See application file for complete search history.

(56) References Cited

U.S. PATENT DOCUMENTS

| | | | | | |
|---|---|---|---|---|---|
| 3,928,933 | A * | 12/1975 | Iwamoto | A63H 3/46 | 446/330 |
| 4,212,132 | A * | 7/1980 | Lewanoni | A63H 3/31 | 446/185 |
| 4,601,671 | A | 7/1986 | DeMars | | |
| 5,378,188 | A | 1/1995 | Clark | | |
| 5,651,717 | A * | 7/1997 | Hamilton | A63H 3/48 | 446/330 |
| 5,785,575 | A * | 7/1998 | Llorens | A63H 3/20 | 446/340 |
| 6,200,190 | B1 * | 3/2001 | Reynolds | A63H 3/20 | 446/330 |

* cited by examiner

*Primary Examiner* — Nini Legesse

(57) ABSTRACT

A squeezable face-covering toy includes a toy figure having a face, left and right arms and a squeeze mechanism mounted inside the toy figure. The squeeze mechanism includes four curved panels connected end-to-end by four hinges, and left and right arm supports configured to support the left and right arms respectively. A spring is fastened between two opposite hinges whereby squeezing the squeeze mechanism moves the arms from an initial face-covering position to a face-revealing position.

20 Claims, 10 Drawing Sheets

SQUEEZABLE FACE-COVERING TOY AND ITS SQUEEZE MECHANISM

CROSS-REFERENCE TO RELATED APPLICATIONS

This application claims the benefit of Chinese Utility Model Application No. 201420582346.2 filed on Oct. 8, 2014, the entire content of which is hereby incorporated by reference.

FIELD OF THE TECHNOLOGY

The present application relates to a squeezable face-covering toy and its squeeze mechanism.

BACKGROUND

In modern society, parents pay special attention to their children. It is indispensable for parents to choose toys for their children when they grow. With time changing and new technology being developed, new elements have been added in toys. Toys are no longer limited to motionless toys. Sounds and actions have been added, and interaction with players is possible. Existing toys with sound and interaction functions usually are very complicated and expensive. It is because the mechanisms of these toys are very complicated, and motors are used to drive gears in gear boxes to drive the toys into action. This causes many limitations. For example, the toys are large in size, heavy and not convenient to carry around. These toys are too heavy for young children to hold, and it is easy for them to lose interest in those toys.

There is a need to provide a squeezable face-covering toy with a squeeze mechanism which is simple in structure, light in weight, easy to carry, low in manufacturing cost, and does not require a motor and complicated gears.

SUMMARY

According to one aspect, there is provided a squeezable face-covering toy including a toy figure having a face on a front side thereof, a left arm on a left side thereof, and a right arm on a right side thereof. A squeeze mechanism may be mounted inside a soft body of the toy figure. The squeeze mechanism may include a front left panel and a front right panel hingedly connected by a front hinge, and a rear left panel and a rear right panel hingedly connected by a rear hinge opposite to the front hinge. The front left panel and the rear left panel may be hingedly connected by a left hinge, and the front right panel and the rear right panel may be hingedly connected by a right hinge opposite to the left hinge. The squeeze mechanism may further include left and right arm supports configured to support the left and right arms respectively. The left and right arm supports may have proximal ends attached to the left and right hinges respectively, and distal ends terminating in front of the face of the toy figure in an initial face-covering position. The squeeze mechanism may be made of plastic. A spring may be disposed within the squeeze mechanism and have two opposite ends fastened at two opposite hinges respectively, whereby squeezing the opposite front and rear hinges inwards towards each other moves the opposite left and right hinges apart and simultaneously moves the distal ends of the left and right arm supports away from the face from the initial face-covering position to a face-revealing position, and releasing the front and rear hinges renders the left and right hinges and the distal ends of the left and right arm supports to return to the initial face-covering position under influence of return force of the spring.

In one embodiment, the spring can be a tension spring, and the two opposite ends of the tension spring are fastened to the opposite left and right hinges respectively. In another embodiment, the spring can be a compression spring, and the two opposite ends of the compression spring are fastened to the opposite front and rear hinges respectively.

In one embodiment, each distal end of the arm supports may be provided with a thread-holding structure configured to hold a thread that is used to tie each distal end of the arm supports to the toy figure. In another embodiment, each distal end of the arm supports may be provided with a palm support, and lateral dimension of the palm supports is greater than that of the arm supports.

In one embodiment, each hinge may include a pin inserted through aligned pin holes formed on opposite-facing edges of two adjacent panels.

The squeezable face-covering toy may further include a sound-generating unit. The sound-generating unit may include a speaker and at least one battery electrically connected with the speaker. The squeezable face-covering toy may further include an integrated circuit electrically connected with the speaker and the battery, and configured to control sound output of the speaker.

In one embodiment, each panel may be a curved panel having a shape of a curved surface of a quarter cylinder. The four hinged panels may have a shape of a cylinder in the initial face-covering position, and a shape of an elliptic cylinder in the face-revealing position.

According to another aspect, there is provided a squeeze mechanism for a squeezable face-covering toy figure having a face on a front side thereof, a left arm on a left side thereof, and a right arm on a right side thereof. The squeeze mechanism may be mountable inside a soft body of the toy figure. The squeeze mechanism may include a front left panel and a front right panel hingedly connected by a front hinge, and a rear left panel and a rear right panel hingedly connected by a rear hinge opposite to the front hinge. The front left panel and the rear left panel may be hingedly connected by a left hinge, and the front right panel and the rear right panel may be hingedly connected by a right hinge opposite to the left hinge. Left and right arm supports may be provided to support the left and right arms respectively. The left and right arm supports may have proximal ends attached to the left and right hinges respectively, and distal ends terminating in front of the face of the toy figure in an initial face-covering position. A spring may be disposed within the squeeze mechanism and may have two opposite ends fastened at two opposite hinges respectively, whereby squeezing the opposite front and rear hinges inwards towards each other moves the opposite left and right hinges apart and simultaneously moves the distal ends of the left and right arm supports away from the face from the initial face-covering position to a face-revealing position, and releasing the opposite front and rear hinges renders the left and right hinges and the distal ends of the left and right arm supports to return to the initial face-covering position under influence of return force of the spring.

In one embodiment, the spring can be a tension spring, and the two opposite ends of the tension spring are fastened to the opposite left and right hinges respectively. In another embodiment, the spring can be a compression spring, and the two opposite ends of the compression spring are fastened to the opposite front and rear hinges respectively.

In one embodiment, each distal end of the arm supports may be provided with a thread-holding structure configured to hold a thread that is used to tie each distal end of the arm supports to the toy figure. In another embodiment, each distal end of the arm supports may be provided with a palm support, and lateral dimension of the palm supports is greater than that of the arm supports.

In one embodiment, each hinge may include a pin inserted through aligned pin holes formed on opposite-facing edges of two adjacent panels.

In one embodiment, each panel can be a curved panel having a shape of a curved surface of a quarter cylinder. The four hinged panels may have a shape of a cylinder in the initial face-covering position, and a shape of an elliptic cylinder in the face-revealing position.

Although the squeezable face-covering toy is shown and described with respect to certain embodiments, it is obvious that equivalents and modifications will occur to others skilled in the art upon the reading and understanding of the specification. The squeezable face-covering toy in the present application includes all such equivalents and modifications, and is limited only by the scope of the claims.

BRIEF DESCRIPTION OF THE DRAWINGS

Specific embodiments of the squeezable face-covering toy will now be described by way of example with reference to the accompanying drawings wherein.

DETAILED DESCRIPTION

Reference will now be made in detail to a preferred embodiment of the squeezable face-covering toy, examples of which are also provided in the following description. Exemplary embodiments of the squeezable face-covering toy are described in detail, although it will be apparent to those skilled in the relevant art that some features that are not particularly important to an understanding of the squeezable face-covering toy may not be shown for the sake of clarity.

Furthermore, it should be understood that the squeezable face-covering toy is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the spirit and scope of the protection.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element or is in mechanical or electrical communication with another element.

FIGS. 1*a*, 3*a*-7*a*, 8, 9*a*, 10 and 11 show different views of a squeeze mechanism of a squeezable face-covering toy according to an embodiment disclosed in the present application. FIGS. 1*b*-7*b*, 2*c*, 9*b*, 12*a* and 12*b* are corresponding photographic representations of those different views of the squeezable face-covering toy with the squeeze mechanism mounted therein.

Figure 1A:
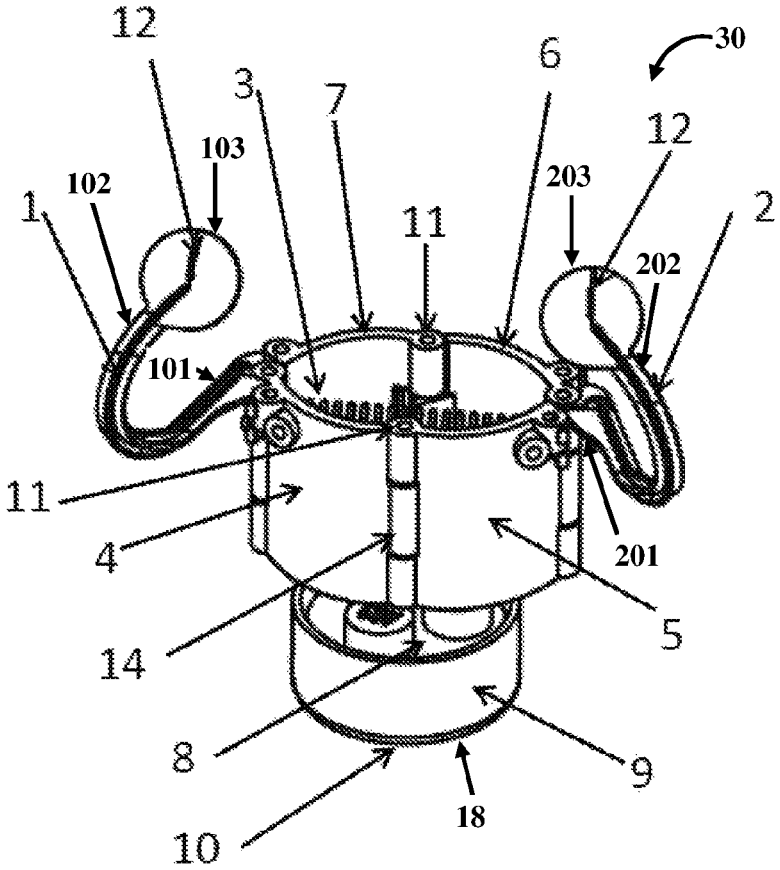
FIG. 1*a* is a front perspective view of a squeeze mechanism of a squeezable face-covering toy in a face-revealing position according to an embodiment disclosed in the present application.
Figure 1B:
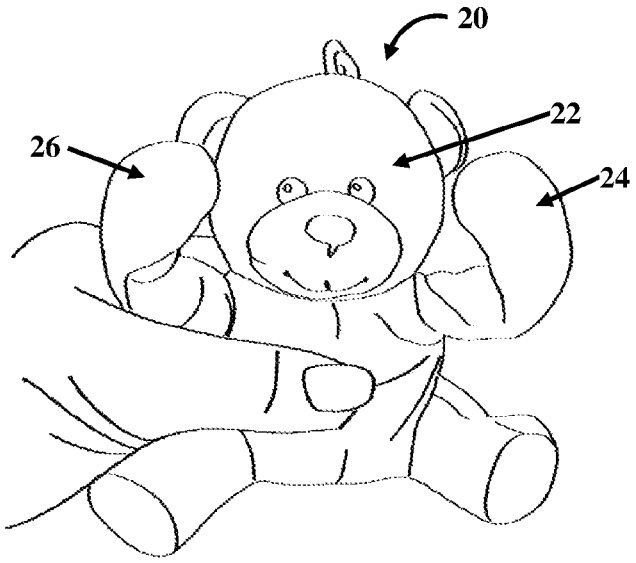
FIG. 1*b* is a photographic representation of the front perspective view of the squeezable face-covering toy with the squeeze mechanism shown in FIG. 1*a* according to an embodiment disclosed in the present application.

As shown in FIG. 1*b*, the squeezable face-covering toy may include a toy FIG. 20 having a face 22 on a front side thereof, a left arm 24 on a left side thereof, and a right arm 26 on a right side thereof. The left and right arms 24, 26 can be used to cover the face 22 as well as the eyes of the toy FIG. 20. According to the present embodiment, the toy figure is a toy bear. It is understood that the toy FIG. 20 can be any toy figure with a face, whether of animals, anthropomorphized animals or humanoids. As used herein, the terms "front", "rear", "left" and "right" refer to the orientation of a structure corresponding to the front face, left and right arms of the toy figure.

The toy FIG. 20 includes a squeeze mechanism 30 which can be mounted inside a soft skin or soft body of the toy FIG. 20. The squeeze mechanism 30 may include four panels 4-7 connected end-to-end by four hinges 14-17. The squeeze mechanism 30 may include a front left panel 5 and a front right panel 4 hingedly connected by a front hinge 14, and a rear left panel 6 and a rear right panel 7 hingedly connected by a rear hinge 15 opposite to the front hinge 14. The front left panel 5 and the rear left panel 6 may be hingedly connected by a left hinge 17, and the front right panel 4 and the rear right panel 7 may be hingedly connected by a right hinge 16 opposite to the left hinge 17. The squeeze mechanism 30 may be made of plastic or metal.

Figure 5A:
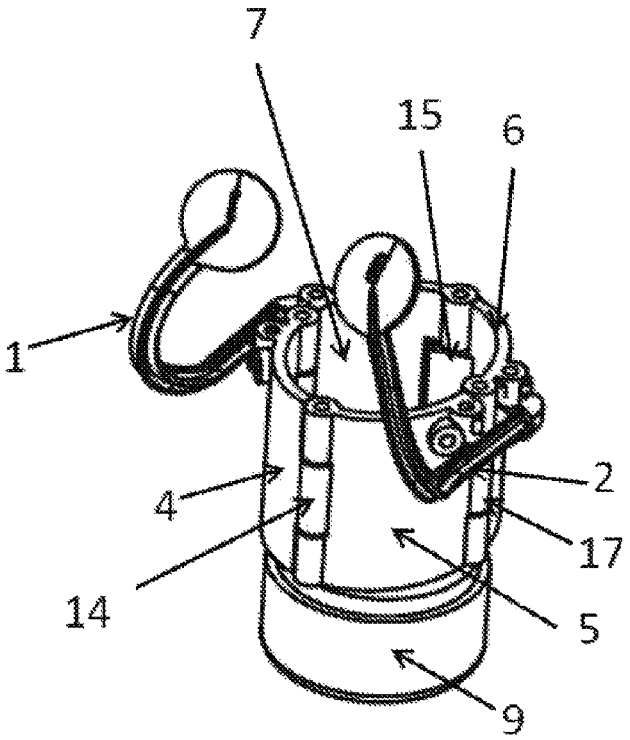
FIG. 5*a* is a front perspective view of the squeeze mechanism of the squeezable face-covering toy in a face-covering position.
Figure 5B:
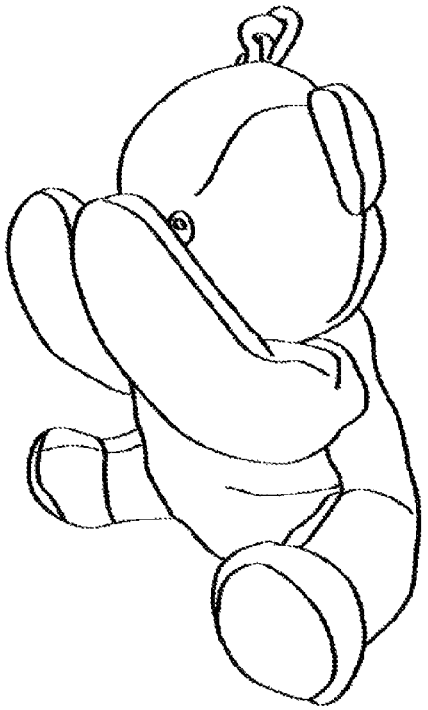
FIG. 5*b* is a photographic representation of the front perspective view of the squeezable face-covering toy with the squeeze mechanism shown in FIG. 5*a*.
Figure 6A:
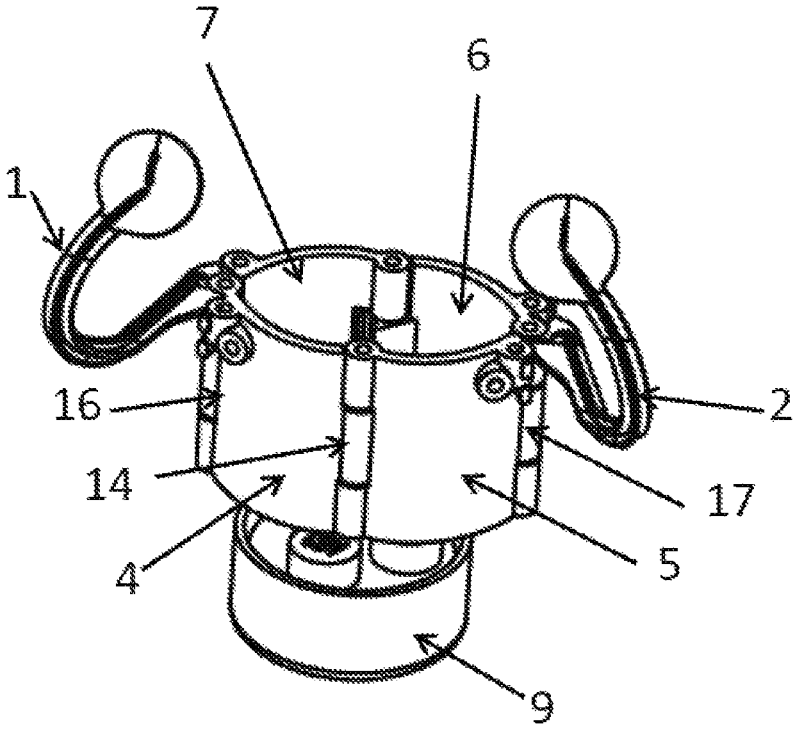
FIG. 6*a* is another front perspective view of the squeeze mechanism of the squeezable face-covering toy in a face-revealing position.
Figure 6B:
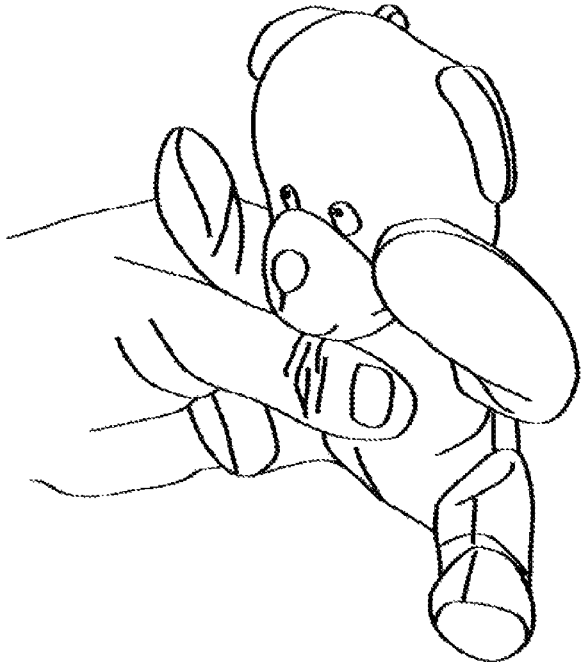
FIG. 6*b* is a photographic representation of another front perspective view of the squeezable face-covering toy with the squeeze mechanism shown in FIG. 6*a*.

According to the illustrated embodiment, each panel 4-7 can be a curved panel having a shape of the curved surface of a quarter cylinder. The four hinged panels 4-7 may therefore have a shape of a cylinder in an initial face-covering position, as best illustrated in FIG. 5*a*, and a shape of an elliptic cylinder in a face-revealing position, as best illustrated in FIG. 6*a*.

The squeeze mechanism 30 may further include a left arm support 2 and a right arm support 1 configured to support the left arm 24 and the right arm 26 of the toy FIG. 20 respectively. The left and right arm supports 2, 1 may have proximal ends 201, 101 attached to the left and right hinges 17, 16 respectively, and distal ends 202, 102 terminating in front of the face 22 of the toy FIG. 20 in the initial face-covering position.

Figure 2A:
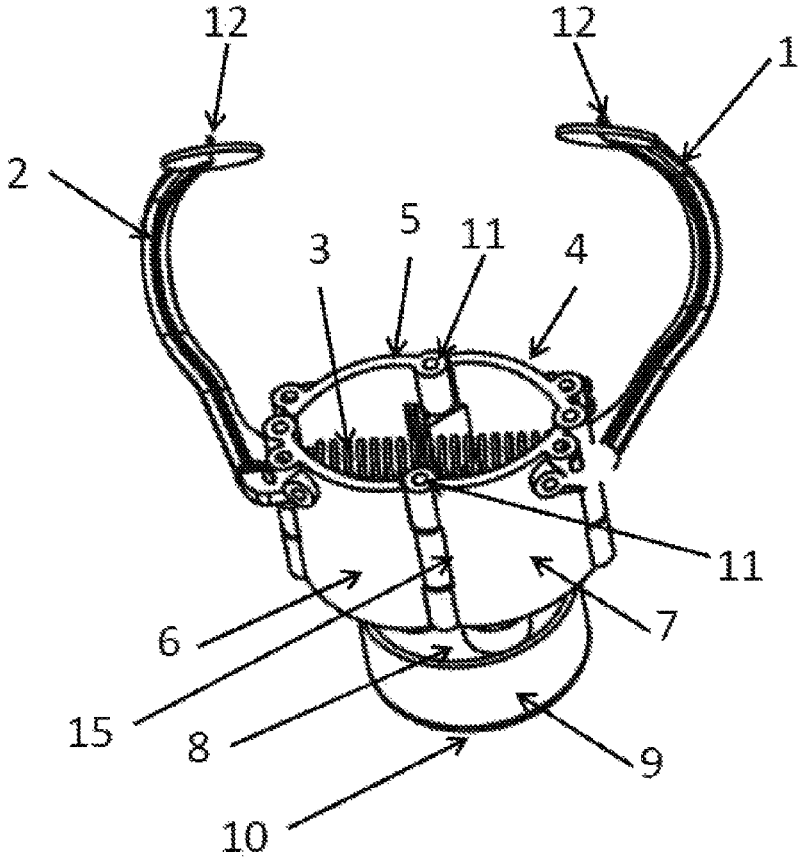
FIG. 2*a* is a rear perspective view of the squeeze mechanism of the squeezable face-covering toy in a face-revealing position.
Figure 2B:
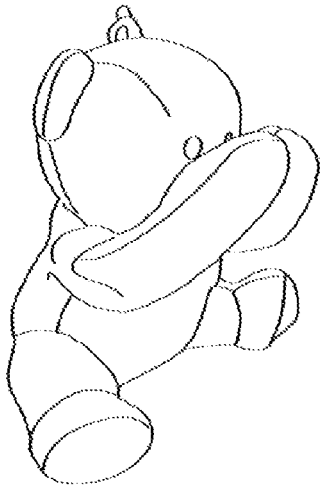
FIGS. 2*b* and 2*c* are photographic representations of the front perspective view and rear view of the squeezable face-covering toy respectively with the squeeze mechanism shown in FIG. 2*a*.
Figure 2C:
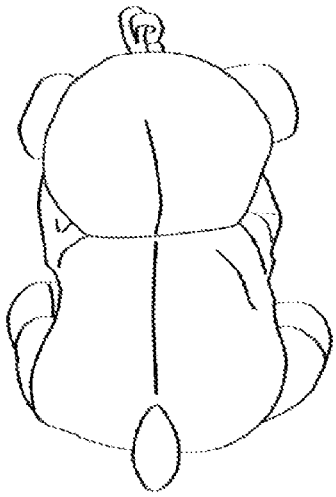
Figure 3A:
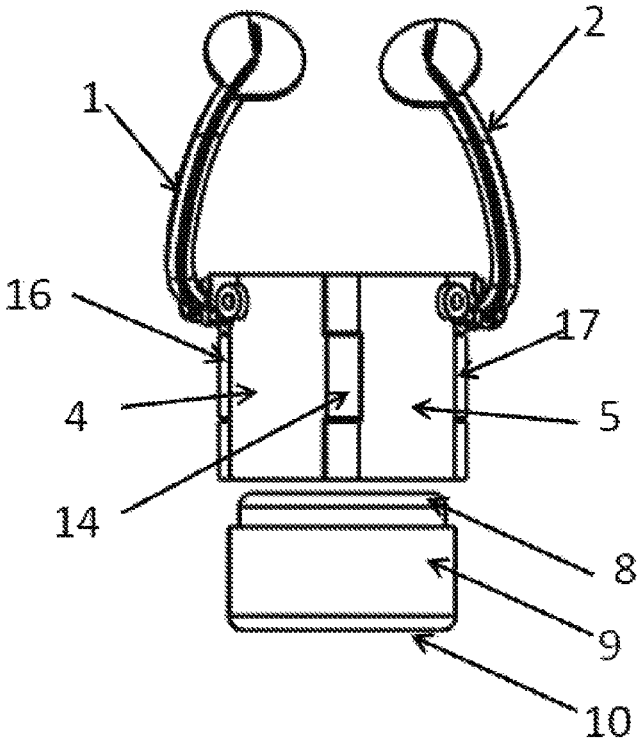
FIG. 3*a* is a front view of the squeeze mechanism of the squeezable face-covering toy in a face-covering position.
Figure 3B:
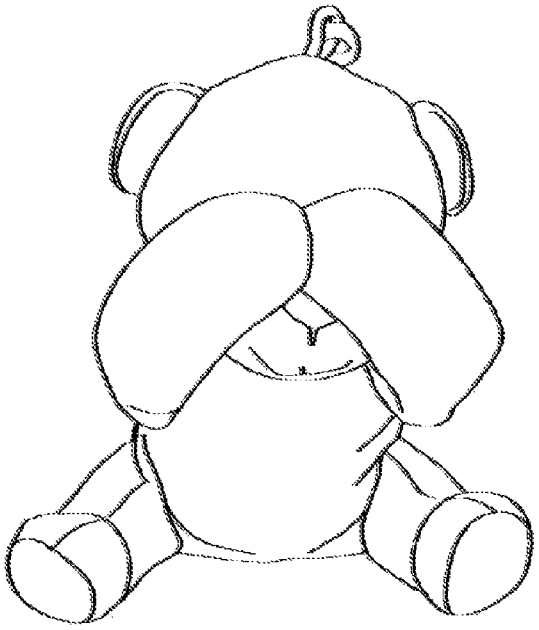
FIG. 3*b* is a photographic representation of the front view of the squeezable face-covering toy with the squeeze mechanism shown in FIG. 3*a*.
Figure 4A:
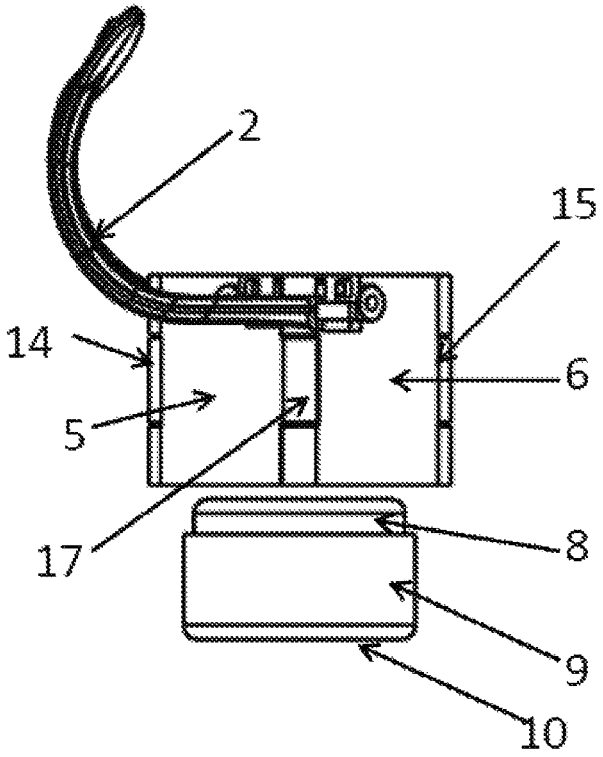
FIG. 4*a* is a side view of the squeeze mechanism of the squeezable face-covering toy in a face-covering position.
Figure 4B:
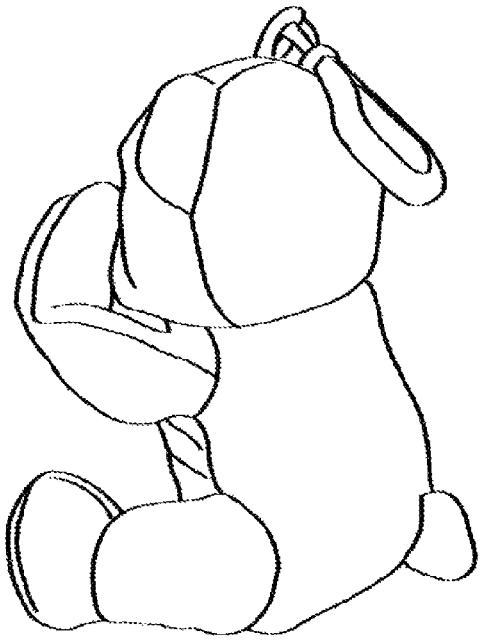
FIG. 4*b* is a photographic representation of the side view of the squeezable face-covering toy with the squeeze mechanism shown in FIG. 4*a*.

A tension spring 3 may be disposed within the squeeze mechanism 30 and may have two opposite ends fastened at the opposite left and right hinges 17, 16 respectively, whereby squeezing the opposite front and rear hinges 14, 15 inwards towards each other can move the opposite left and right hinges 17, 16 apart and simultaneously move the distal ends 202, 102 of the left and right arm supports 2, 1 away from the face 22 of the toy FIG. 20 from the initial face-covering position, as best illustrated in FIGS. 3*a* and 3*b*, to the face-revealing position, as best illustrated in FIGS. 1*a*, 1*b* and 2*a*, and releasing the opposite front and rear hinges 14, 15 renders the left and right hinges 17, 16 and the distal ends 202, 102 of the left and right arm supports 2, 1 to return to the initial face-covering position under influence of return force of the tension spring 3.

Figure 7A:
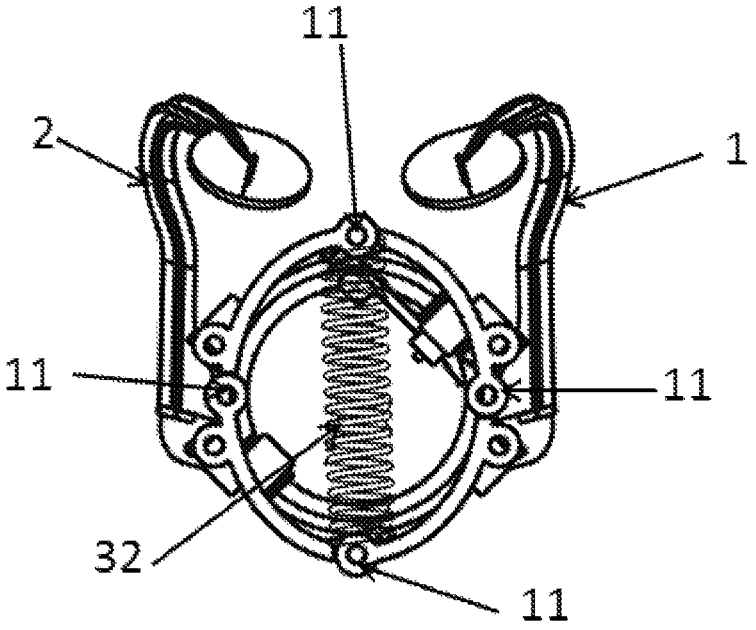
FIG. 7*a* is a top view of the squeeze mechanism of the squeezable face-covering toy in a face-covering position.
Figure 7B:
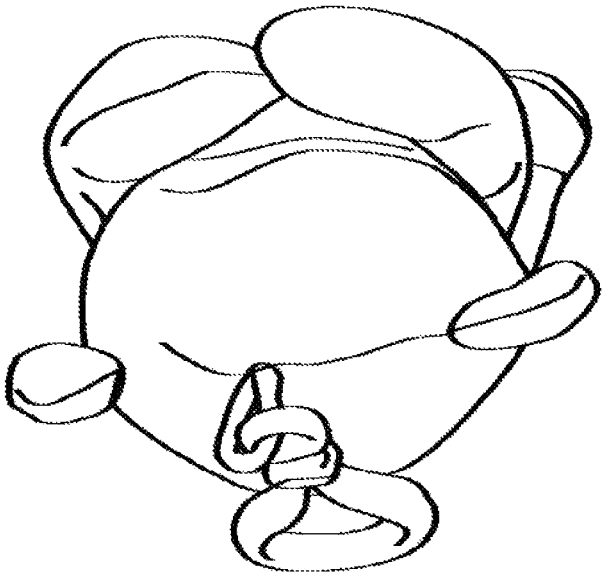
FIG. 7*b* is a photographic representation of the top view of the squeezable face-covering toy with the squeeze mechanism shown in FIG. 7*a*.
Figure 8:
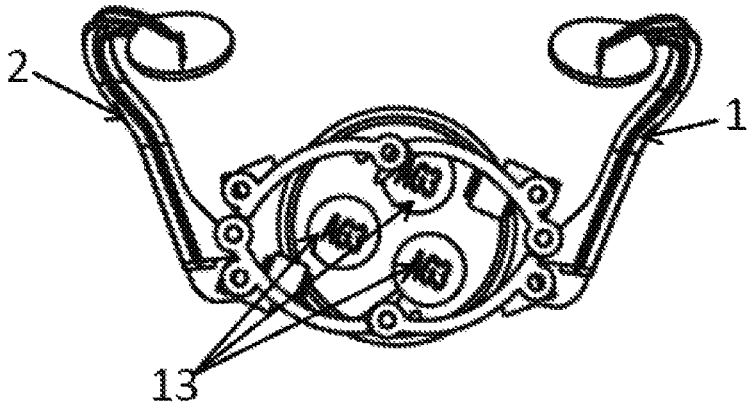
FIG. 8 is a top view of the squeeze mechanism of the squeezable face-covering toy in a face-revealing position with the spring being removed to reveal the batteries.
Figure 9A:
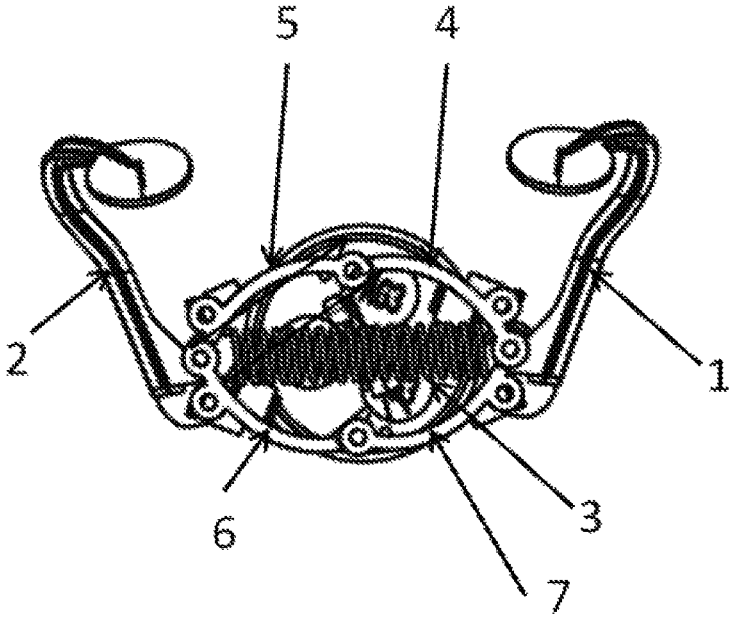
FIG. 9*a* is a top view of the squeeze mechanism of the squeezable face-covering toy in a face-revealing position.
Figure 9B:
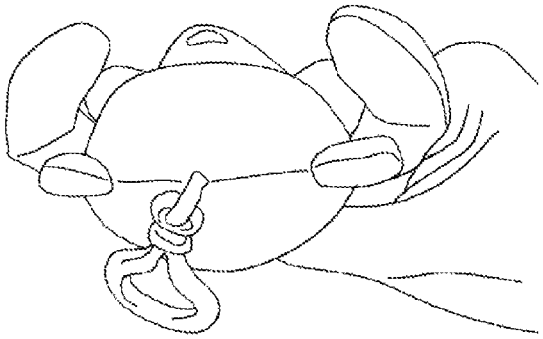
FIG. 9*b* is a photographic representation of the top view of the squeezable face-covering toy with the squeeze mechanism shown in FIG. 9*a*.
Figure 10:
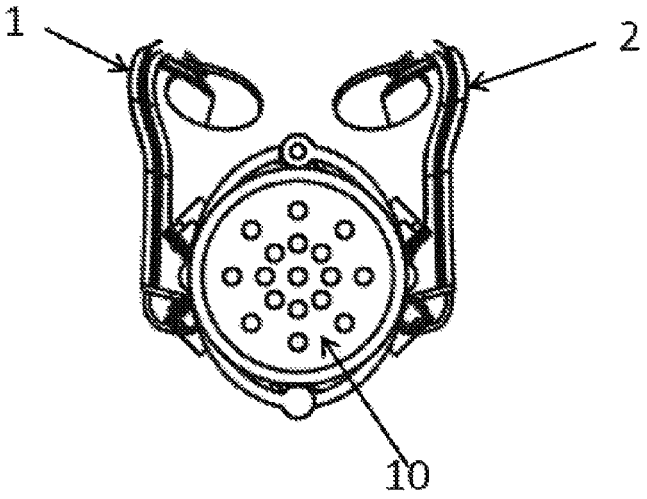
FIG. 10 is a bottom view of the squeeze mechanism of the squeezable face-covering toy in a face-covering position.
Figure 11:
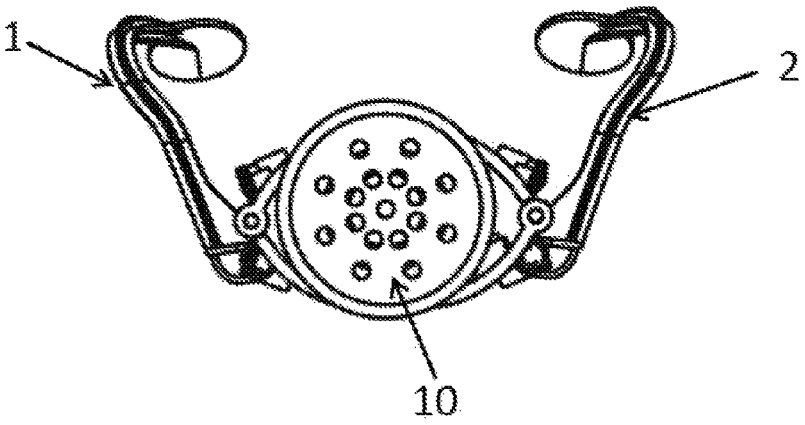
FIG. 11 is a bottom view of the squeeze mechanism of the squeezable face-covering toy in a face-revealing position.
Figure 12A:
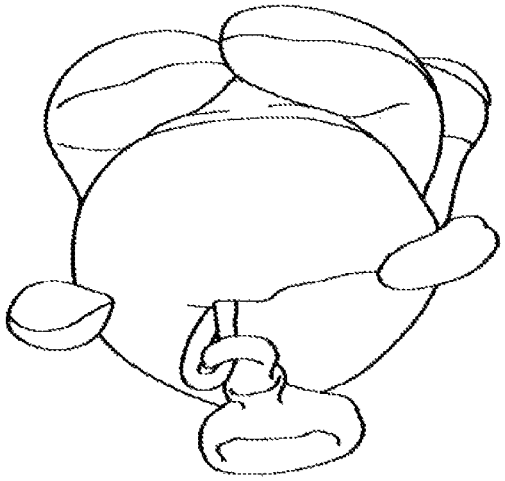
FIG. 12*a* is a photographic representation of the top view of the squeezable face-covering toy in a face-covering position.
Figure 12B:
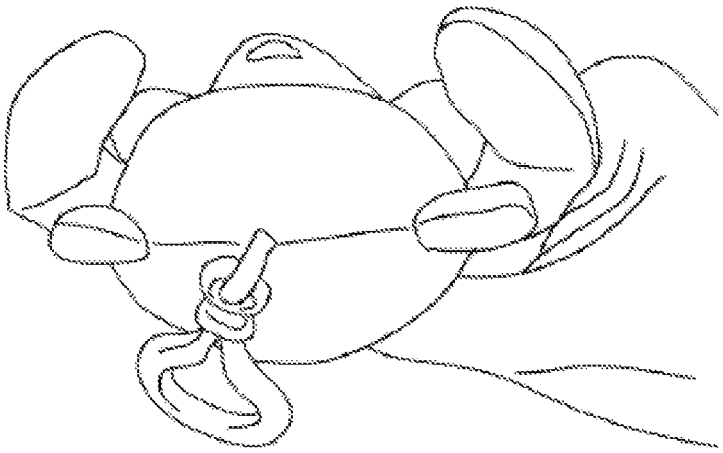
FIG. 12*b* is a photographic representation of the top view of the squeezable face-covering toy in a face-revealing position.

Although it has been shown and described that the squeeze mechanism 30 is provided with a tension spring 3, and the two opposite ends of the tension spring 3 are fastened to the opposite left and right hinges 17, 16 respectively, it is understood that the squeeze mechanism 30 may be provided with a compression spring 32, and the two opposite ends of the compression spring 32 may be fastened to the opposite front and rear hinges 14, 15 respectively, as depicted in FIG. 7*a*.

Each distal end 202, 102 of the arm supports 2, 1 may be provided with a thread-holding structure 12 configured to hold a thread that is used to tie each distal end 202, 102 of the arm supports 2, 1 to the toy FIG. 20. In one embodiment, the thread-holding structure 12 may be in the form of an opening through which a thread can pass.

Furthermore, each distal end 202, 102 of the arm supports 2, 1 may be formed with a palm support 203, 103, and lateral or crosswise dimension of the palm supports 203, 103 may be greater than that of the arm supports 2, 1.

In the present embodiment, each hinge 14-17 may include a pin 11 inserted through aligned pin holes formed on opposite-facing edges of two adjacent panels. It is understood that the hinges 14-17 can be any other appropriate hinge.

The squeezable face-covering toy may further include a sound-generating unit. The sound-generating unit may include a speaker 10 and at least one battery 13 electrically connected with the speaker 10. The battery 13 may be held in a battery compartment 8. The speaker 10 and the battery compartment 8 may be fixed inside a bottom housing 9 disposed underneath the squeeze mechanism 30. The sound-generating unit may further include an integrated circuit 18 electrically connected with the speaker 10 and the battery 13, and configured to control the sound output of the speaker 10.

While the squeezable face-covering toy has been shown and described with particular references to a number of preferred embodiments thereof, it should be noted that various other changes or modifications may be made without departing from the scope of the appended claims.

What is claimed is:

1. A squeezable face-covering toy comprising:

(a) a toy figure having a face on a front side thereof, a left arm on a left side thereof, and a right arm on a right side thereof;

(b) a squeeze mechanism mounted inside a soft body of the toy figure, the squeeze mechanism comprising a front left panel and a front right panel hingedly connected by a front hinge, and a rear left panel and a rear right panel hingedly connected by a rear hinge opposite to the front hinge, the front left panel and the rear left panel being hingedly connected by a left hinge, and the front right panel and the rear right panel being hingedly connected by a right hinge opposite to the left hinge;

(c) the squeeze mechanism further comprising left and right arm supports configured to support the left and right arms respectively, the left and right arm supports having proximal ends attached to the left and right hinges respectively, and distal ends terminating in front of the face of the toy figure in an initial face-covering position; and (d) a spring disposed within the squeeze mechanism and having two opposite ends fastened at two opposite hinges respectively;

(e) whereby squeezing the opposite front and rear hinges inwards towards each other moves the opposite left and right hinges apart and simultaneously moves the distal ends of the left and right arm supports away from the face from the initial face-covering position to a face-revealing position, and releasing the front and rear hinges renders the left and right hinges and the distal ends of the left and right arm supports to return to the initial face-covering position under influence of return force of the spring.

2. The squeezable face-covering toy as claimed in claim 1, wherein the spring is a tension spring, and the two opposite ends of the tension spring are fastened to the opposite left and right hinges respectively.

3. The squeezable face-covering toy as claimed in claim 1, wherein the spring is a compression spring, and the two opposite ends of the compression spring are fastened to the opposite front and rear hinges respectively.

4. The squeezable face-covering toy as claimed in claim 1, wherein each distal end of the arm supports is provided with a thread-holding structure configured to hold a thread that is used to tie each distal end of the arm supports to the toy figure.

5. The squeezable face-covering toy as claimed in claim 1, wherein each distal end of the arm supports is provided with a palm support, and lateral dimension of the palm supports is greater than that of the arm supports.

6. The squeezable face-covering toy as claimed in claim 1, wherein each hinge comprises a pin inserted through aligned pin holes formed on opposite-facing edges of two adjacent panels.

7. The squeezable face-covering toy as claimed in claim 1, further comprising a sound-generating unit.

8. The squeezable face-covering toy as claimed in claim 7, wherein the sound-generating unit comprises a speaker and at least one battery electrically connected with the speaker.

9. The squeezable face-covering toy as claimed in claim 8, further comprising an integrated circuit electrically connected with the speaker and the battery, and configured to control sound output of the speaker.

10. The squeezable face-covering toy as claimed in claim 1, wherein each panel is a curved panel having a shape of a curved surface of a quarter cylinder.

11. The squeezable face-covering toy as claimed in claim 10, wherein the four hinged panels have a shape of a cylinder in the initial face-covering position, and a shape of an elliptic cylinder in the face-revealing position.

12. The squeezable face-covering toy as claimed in claim 1, wherein the squeeze mechanism is made of plastic.

13. A squeeze mechanism for a squeezable face-covering toy figure having a face on a front side thereof, a left arm on a left side thereof, and a right arm on a right side thereof, the squeeze mechanism being mountable inside a soft body of the toy figure and comprising:

(a) a front left panel and a front right panel hingedly connected by a front hinge, and a rear left panel and a rear right panel hingedly connected by a rear hinge opposite to the front hinge, the front left panel and the rear left panel being hingedly connected by a left hinge, and the front right panel and the rear right panel being hingedly connected by a right hinge opposite to the left hinge;

(b) left and right arm supports configured to support the left and right arms respectively, the left and right arm supports having proximal ends attached to the left and right hinges respectively, and distal ends terminating in front of the face of the toy figure in an initial face-covering position; and (c) a spring disposed within the squeeze mechanism and having two opposite ends fastened at two opposite hinges respectively;

(d) whereby squeezing the opposite front and rear hinges inwards towards each other moves the opposite left and right hinges apart and simultaneously moves the distal ends of the left and right arm supports away from the face from the initial face-covering position to a face-revealing position, and releasing the opposite front and rear hinges renders the left and right hinges and the distal ends of the left and right arm supports to return to the initial face-covering position under influence of return force of the spring.

14. The squeeze mechanism as claimed in claim 13, wherein the spring is a tension spring, and the two opposite ends of the tension spring are fastened to the opposite left and right hinges respectively.

15. The squeeze mechanism as claimed in claim 13, wherein the spring is a compression spring, and the two opposite ends of the compression spring are fastened to the opposite front and rear hinges respectively.

16. The squeeze mechanism as claimed in claim 13, wherein each distal end of the arm supports is provided with a thread-holding structure configured to hold a thread that is used to tie each distal end of the arm supports to the toy figure.

17. The squeeze mechanism as claimed in claim 13, wherein each distal end of the arm supports is provided with a palm support, and lateral dimension of the palm supports is greater than that of the arm supports.

18. The squeeze mechanism as claimed in claim 13, wherein each hinge comprises a pin inserted through aligned pin holes formed on opposite-facing edges of two adjacent panels.

19. The squeeze mechanism as claimed in claim 13, wherein each panel is a curved panel having a shape of a curved surface of a quarter cylinder.

20. The squeeze mechanism as claimed in claim 19, wherein the four hinged panels have a shape of a cylinder in the initial face-covering position, and a shape of an elliptic cylinder in the face-revealing position.

* * * * *